US005542497A

United States Patent [19]

Macyszyn

[11] Patent Number: 5,542,497

[45] Date of Patent: Aug. 6, 1996

[54] LADDER LEVEL ADJUSTING ATTACHMENT

[76] Inventor: Witold S. Macyszyn, P.O. Box 612, Hackettstown, N.J. 07840

[21] Appl. No.: 338,700

[22] Filed: Nov. 14, 1994

[51] Int. Cl.[6] ..... E06C 7/00

[52] U.S. Cl. ..... 182/201; 182/204; 248/188.2

[58] Field of Search ..... 182/201, 202, 182/203, 204, 205, 214; 248/188.2, 188.9

[56] References Cited

U.S. PATENT DOCUMENTS

| | | | |
|---|---|---|---|
| 979,821 | 12/1910 | Brasington | 182/205 |
| 1,376,777 | 5/1921 | O'Connor | 182/205 |
| 1,718,891 | 6/1929 | Bratt | 182/201 |
| 1,733,338 | 10/1929 | Enke | 182/204 |
| 2,408,372 | 10/1946 | Chase | 182/204 |
| 2,936,849 | 5/1960 | Larson | 182/204 |
| 3,554,321 | 1/1971 | Stedman | 182/201 |
| 5,064,024 | 11/1991 | Barham | 182/201 |
| 5,107,958 | 4/1992 | Johnson | 182/204 |
| 5,181,584 | 1/1993 | Simard | 182/201 |
| 5,222,575 | 1/1993 | Santos | 182/108 |
| 5,273,133 | 12/1993 | Thoucher et al. | 182/202 |

*Primary Examiner*—Karen J. Chotkowski
*Attorney, Agent, or Firm*—Richard L. Miller, P.E.

[57] ABSTRACT

A ladder level adjusting attachment for a ladder of the type having a pair of generally parallel side rails, a plurality of hollow rungs interconnecting the side rails and a pair of shoes, each located on a bottom end of each side rail. The attachment comprising at least one but typically two independent, identical and height adjustable support assemblies. A structure is for installing the support assembly against the side rail of the ladder. Support assembly can be height adjusted independently to allow the ladder to stand in a level and stationary position, with respect to all uneven floor and ground base conditions.

3 Claims, 1 Drawing Sheet

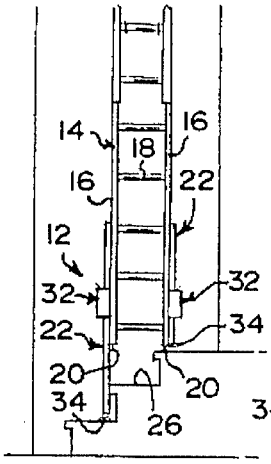
Fig. 1
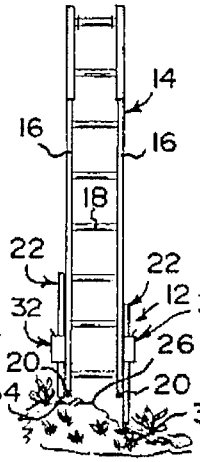
Fig. 2
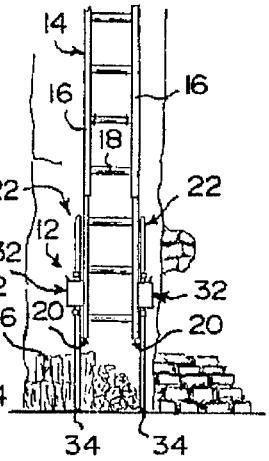
Fig. 3
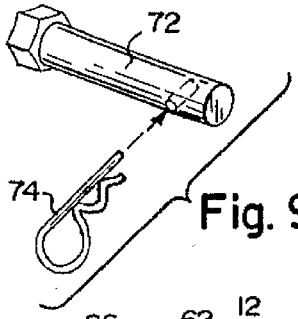
Fig. 9
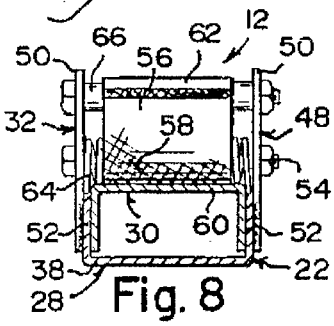
Fig. 8
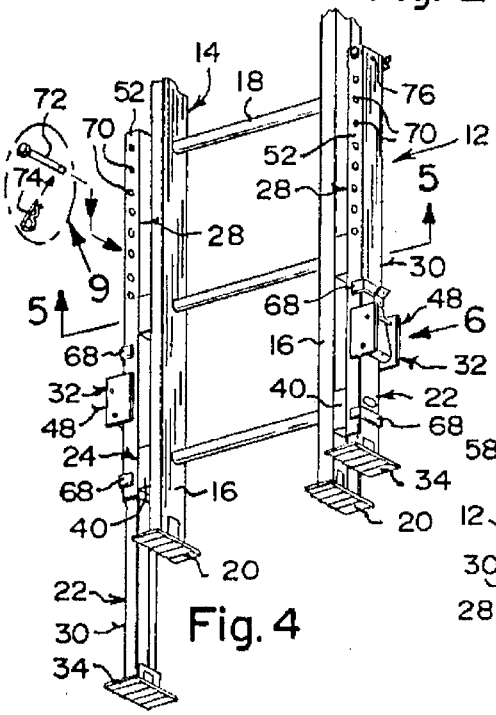
Fig. 4
Fig. 6
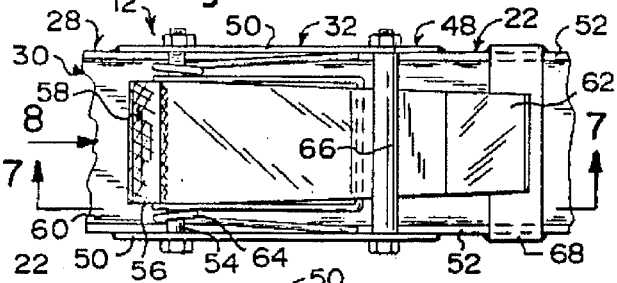
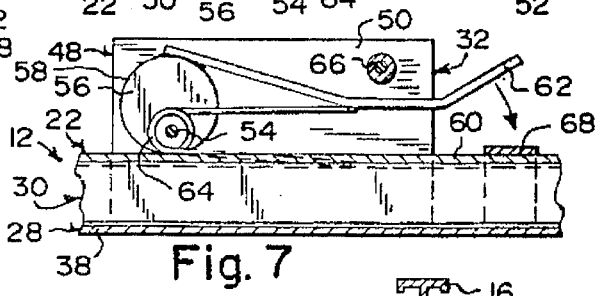
Fig. 7
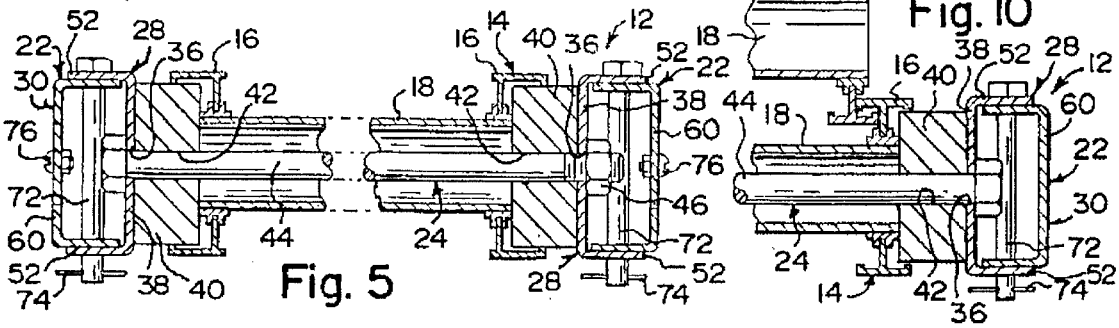
Fig. 5

LADDER LEVEL ADJUSTING ATTACHMENT

BACKGROUND OF THE INVENTION

The instant invention relates generally to ladder levelers and more specifically it relates to a ladder level adjusting attachment.

Numerous ladder levelers have been provided in prior art that are adapted to stabilize ladders in places where the ground or floor is not level and to prevent ladders from sliding away and out from inclined positions. For example, U.S. Pat. Nos. 5,107,958 to Johnson; 5,181,584 to Simard; 5,222,575 to Santos and 5,273,133 to Thocher et al. all are illustrative of such prior art. While these units may be suitable for the particular purpose to which they address, they would not be as suitable for the purposes of the present invention as heretofore described.

SUMMARY OF THE INVENTION

A primary object of the present invention is to provide a ladder level adjusting attachment that will overcome the shortcomings of the prior art devices.

Another object is to provide a ladder level adjusting attachment that can be quickly installed to an existing ladder without the use of special tools, equipment and skills in the installation thereof.

An additional object is to provide a ladder level adjusting attachment, in which a cam self-locking mechanism is utilized in adjusting the attachment to the ladder, so as to stabilize and maintain the ladder in a vertical position with respect to all uneven floor and ground base conditions.

A further object is to provide a ladder level adjusting attachment that is simple and easy to use.

A still further object is to provide a ladder level adjusting attachment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a diagrammatic elevational view illustrating a ladder incorporating an embodiment of the instant invention standing on a staircase;

FIG. 2 is a diagrammatic elevational view illustrating a ladder incorporation an embodiment of the instant invention standing on uneven ground;

FIG. 3 is a diagrammatic elevational view illustrating a ladder incorporating an embodiment of the instant invention standing over and straddling on a pile debris;

FIG. 4 is an enlarged diagrammatic perspective view of a ladder with parts broken away illustrating the instant invention installed thereon;

FIG. 5 is an enlarged cross sectional view taken on line 5—5 of FIG. 4;

FIG. 6 is an enlarged side view with parts broken away taken in the direction of arrow 6 in FIG. 4;

FIG. 7 is a cross sectional view taken on line 7—7 of FIG. 6;

FIG. 8 is a cross sectional bottom view taken in the direction of arrow 8 in FIG. 6;

FIG. 9 is an enlarged exploded perspective view of the safety pin and cotter key utilized with the instant invention as indicated by arrow 9 in FIG. 4; and FIG. 10 is an enlarged cross sectional view also taken on line 5—5 of FIG. 4, but illustrating the instant invention alternatively installed on an extension ladder.

DETAILED DESCRIPTION OF THE PREFERRED EMBODIMENTS

Turning now descriptively to the drawings, in which similar reference characters denote similar elements throughout the several views, FIGS. 1 through 10 illustrate a ladder level adjusting attachment 12 for a ladder 14 of the type having a pair of generally parallel side rails 16, a plurality of hollow rungs 18 interconnecting the side rails 16 and a pair of shoes 20, each located on a bottom end of each side rail 16. The attachment 12 comprising two independent, identical and height adjustable support assemblies 22. A structure 24 is for installing both of the support assemblies 22 against the side rails 16 of the ladder 14. Each support assembly 22 can be height adjusted independently to allow the ladder 14 to stand in a level and stationary position, with respect to all uneven floor and ground base conditions 26, such as a staircase in FIG. 1, uneven ground in FIG. 2 and a pile of debris in FIG. 3.

Each support assembly 22 includes an outer channel member 28, with an inner channel member 30 to ride within the outer channel member 28. A unit 32 on the outer channel member 28 is for locking the inner channel member 30 in an adjusted position within the outer channel member 28. A shoe 34 is on a bottom end of the inner channel member 30.

The installing structure 24, as best shown in FIGS. 5 and 10, consists of each outer channel member 28 having two spaced apart holes 36 through a back wall 38 thereof. Four spacers 40 are provided, with each spacer 40 having an aperture 42 therethrough. Two of the spacers 40 are each adapted to be placed in alignment between one side rail 16 at one hollow rung 18 and one hole 36 in the back wall of the outer channel member 28. Two elongated bolts 44 are provided. Each bolt 44 is adapted to be inserted through one hole 36 in each back wall 38 of each outer channel 28, the aperture 42 in the two spacers 40 on opposite side rails 16 and one hollow rung 18. Two nuts 46 are also utilized. Each nut 46 is threaded onto one end of each elongated bolt 44 to retain the two outer channel members 28 in a stationary position against the two side rails 16.

Each locking unit 32, as best shown in FIGS. 6, 7 and 8, is a cam self-locking mechanism 48 and contains a pair of plates 50. Each plate 50 is affixed to and extends from one side wall 52 of the outer channel member 28. The plates 50 are directly opposite from each other. A shaft 54 extends through the plates 50. A cam cylinder 56 has a knurled surface 58 and is eccentrically carried on the shaft 54 between the plates 50. The knurled surface 58 can engage with a front wall 60 of the inner channel member 30. A lever 62 is affixed to the knurled surface 58 of the cam cylinder 56, so that the lever 62 will extend longitudinally between the plates 50. A spring 64 is on the shaft 54 to normally bias the lever 62 outwardly away from the front wall 60 of the inner channel member 30. When the lever 62 is depressed towards the front wall 60, the cam cylinder 56 will disengage from the front wall 60 of the inner channel member 30, allowing the inner channel member 30 to slide in the outer channel member 28 for adjustment. A connecting rod 66 extends between the plates 50 over the lever 62, to prevent the lever 62 from accidentally pulling out therefrom and to add rigidity thereto.

Each outer channel member 28 includes a pair of safety straps 68. Each safety strap 68 is secured to the outer channel member 28 on opposite sides of the cam self-locking mechanism 48, to keep the inner channel member 30 in a stable position and to avoid accidental relocation of the inner channel member 30, in case of engagement failure of the cam cylinder 56.

Each of the outer channel members 28 has a plurality of aligned apertures 70 along the opposite side walls 52. A pair of safety pins 72 are provided. Each safety pin 72 can be inserted through any two of the aligned apertures 70 in the side walls 52. A pair of cotter keys 74 are provided. Each cotter key 74 can engage with each safety pin 72, so as to prevent the position of the inner channel member 30 from drastically changing accidently if there is engagement failure of the cam cylinder 56, while the ladder is in use. A pair of stop bolts 76 are also provided. Each stop bolt 76 is secured to an upper end of the front wall 60 of one inner channel member 30. This prevents the inner channel member 30 from coming completely out of the outer channel member 28, since the stop bolt 76 will make contact with the upper safety strap 28.

OPERATION OF THE INVENTION

To use the ladder level adjusting attachment 12, simply mount the support assemblies 22 against the side rails 16 with the installing structure 24. Press in any one of the levers 62, so that the cam cylinder 56 will release the inner channel member 30, to allow adjustment of the inner channel member 30 with respect to the outer channel member 28. Now the ladder 14 can be placed upon an uneven floor or ground base condition 26.

It should be noted that although the leveler invention through out this specification up until this point is indicated to be used in pairs one can be used singly on just one rail of a ladder for an uneven surface sloped in a particular direction; or if the user is willing to remove the device and switch it back and forth as may required from the left rail to the right rail, or alternatively if the ladder is so constructed that it can be climbed properly from either side than just one leveler will suffice for slopes in all directions.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ladder level adjusting attachment for a ladder of the type having a pair of generally parallel side rails, a plurality of hollow rungs interconnecting the side rails and a pair of shoes, each located on a bottom end of each side rail, said attachment comprising:

a) two independent, identical and height adjustable support assemblies, wherein each said support assembly comprises:

i) an outer channel member;

ii) an inner channel member to ride within said outer channel member;

iii) means on said outer channel member for locking said inner channel member in an adjusted position within said outer channel member; and iv) a shoe on a bottom end of said inner channel member; and b) means for installing both of said support assemblies against the side rails of the ladder, so that each said support assembly can be height adjusted independently to allow the ladder to stand in a level and stationary position, with respect to all uneven floor and ground base conditions, wherein said installing means comprises:

i) each said outer channel member having two spaced apart holes through a back wall thereof;

ii) four spacers, with each said spacer having an aperture therethrough, whereby two of said spacers are each adapted to be placed in alignment between one side rail at one hollow rung and one said hole in said back wall of one said outer channel member;

iii ) two elongated bolts, whereby each said bolt is adapted to be inserted through one said hole in each said back wall of each said outer channel, said aperture in said two spacers on opposite side rails and one hollow rung; and iv) two nuts, whereby each said nut is threaded onto one end of each said elongated bolt to retain said two outer channel members in a stationary position against the two side rails, wherein each said locking means is a cam self-locking mechanism and comprises:

i) a pair of plates, each said plate affixed to and extending from one side wall of said outer channel member, so that said plates are directly opposite from each other;

ii) a shaft extending through said plates;

iii) a cam cylinder having a knurled surface and eccentrically carried on said shaft between said plates, so that the knurled surface can engage with a front wall of said inner channel member;

iv) a lever affixed to the knurled surface of said cam cylinder, so that said lever will extend longitudinally between said plates;

v) a spring on said shaft to normally bias said lever outwardly away from the front wall of said inner channel member, so that when said lever is depressed towards the front wall, said cam cylinder will disengage from the front wall of said inner channel member, allowing said inner channel member to slide in said outer channel member for adjustment; and vi) a connecting rod extending between said plates over said lever, to prevent said lever from accidentally pulling out therefrom and to add rigidity thereto.

2. A ladder level adjusting attachment as recited in claim 1, wherein each said outer channel member includes a pair of safety straps, whereby each said safety strap is secured to said outer channel member on opposite sides of said cam self-locking mechanism to keep said inner channel member in a stable position and to avoid accidental relocation of said inner channel member in case of engagement failure of said cam cylinder.

3. A ladder level adjusting attachment as recited in claim 2, further including:

a) each of said outer channel members having a plurality of aligned apertures along the opposite side walls;

b) a pair of safety pins, whereby each said safety pin can be inserted through any two of said aligned apertures in the side walls;

c) a pair of cotter keys, whereby each said cotter key can engage with each said safety pin, so as to prevent the position of said inner channel member from changing drastically if there is engagement failure of said cam cylinder; and d) a pair of stop bolts, whereby each said stop bolt is secured to an upper end of said front wall of one said inner channel member, so as to prevent said inner channel member from coming completely out of said outer channel member, since said stop bolt will make contact with said upper safety strap.

* * * * *